US005273675A

United States Patent [19]

Lein et al.

[11] Patent Number: 5,273,675

[45] Date of Patent: Dec. 28, 1993

[54] PHOSPHATE-FREE LIQUID CLEANING COMPOSITIONS CONTAINING POLYMER

[75] Inventors: George M. Lein, Chalfont, Pa.; Robert M. Weinheimer, Charleston, W. Va.

[73] Assignee: Rohm and Haas Company, Philadelphia, Pa.

[21] Appl. No.: 931,647

[22] Filed: Aug. 17, 1992

Related U.S. Application Data

[63] Continuation of Ser. No. 724,486, Jun. 27, 1991, abandoned, which is a continuation-in-part of Ser. No. 481,078, Feb. 16, 1990, abandoned.

[51] Int. Cl.[5] ..... C11D 3/37; C11D 3/395; C11D 7/54

[52] U.S. Cl. ..... 252/103; 252/95; 252/156; 252/173; 252/174.24; 252/186.1; 252/187.23; 252/187.26

[58] Field of Search ..... 252/174.24, 156, 95, 252/103, 94, 173, 186.1, 187.23, 187.26

[56] References Cited

U.S. PATENT DOCUMENTS

| | | | |
|---|---|---|---|
| 4,071,377 | 1/1978 | Schwuger et al. | 134/29 |
| 4,120,650 | 10/1978 | Kappler et al. | 8/109 |
| 4,169,934 | 10/1979 | Papanu | 525/418 |
| 4,559,159 | 12/1985 | Denzinger et al. | 252/174.24 |
| 4,579,676 | 4/1986 | Bull | 252/94 |
| 4,608,188 | 8/1986 | Parker et al. | 252/99 |
| 4,647,396 | 3/1987 | Denzinger et al. | 252/174.24 |
| 4,698,174 | 10/1987 | Denzinger et al. | 252/174.24 |
| 4,786,433 | 11/1988 | Marguardt et al. | 252/174.24 |
| 4,826,618 | 5/1989 | Borseth et al. | 252/174.21 |
| 4,844,744 | 7/1989 | Leiter et al. | 134/40 |
| 4,857,226 | 8/1989 | Drapier et al. | 252/174.25 |
| 4,897,215 | 1/1990 | Trieselt et al. | 252/174.24 |
| 4,933,101 | 6/1990 | Cilley et al. | 252/99 |
| 4,935,065 | 7/1990 | Bull | 134/22.13 |
| 5,004,557 | 4/1991 | Nagarajan et al. | 252/174.24 |

FOREIGN PATENT DOCUMENTS

| | | |
|---|---|---|
| 0025551 | 3/1981 | European Pat. Off. . |
| 0124913 | 11/1984 | European Pat. Off. . |
| 0322946A2 | 7/1989 | European Pat. Off. . |
| 3627773 | 2/1988 | Fed. Rep. of Germany . |
| 9013622 | 11/1990 | PCT Int'l Appl. . |

*Primary Examiner*—Paul Lieberman
*Assistant Examiner*—Erin M. Higgins
*Attorney, Agent, or Firm*—James G. Vouros; David T. Banchik

[57] ABSTRACT

The present invention relates to alkaline, aqueous cleaning concentrates and cleaning solutions comprising a solution of an alkali metal hydroxide, an active chlorine source, water soluble copolymers of a monoethylenically unsaturated dicarboxylic acid and monoethylenically unsaturated monocarboxylic acid, water and optionally an alkali metal silicate. These cleaning solutions are useful for the cleaning of food soils, more specifically, are useful for the removal of milk soils from cold and hot surfaces without the use of phosphate builders.

13 Claims, No Drawings

PHOSPHATE-FREE LIQUID CLEANING COMPOSITIONS CONTAINING POLYMER

This application is a continuation of application Ser. No. 724,486, filed Jun. 27, 1991 now abandoned which is a continuation in part of application Ser. No. 481,078, filed Feb. 16, 1990 now abandoned.

FIELD OF THE INVENTION

The present invention relates to alkaline, aqueous cleaning concentrates and cleaning solutions comprising a solution of an alkali metal hydroxide, an active chlorine source, water soluble copolymers of a monoethylenically unsaturated dicarboxylic acid and monoethylenically unsaturated monocarboxylic acid, water and optionally an alkali metal silicate. These cleaning solutions are useful for the cleaning of food soils, more specifically, are useful for the removal of milk soils from cold and hot surfaces without the use of phosphate builders.

BACKGROUND OF INVENTION

Dairy soils are composed of two components, the soil left behind from the milk processing operation and the soil left behind at the end of the cleaning operation. The soil resulting from the milk processing operation can vary widely in composition depending on, for example, the breed of cows, the time of year and the cow's food source. Additionally, if the surface contacting the milk is a heated surface, as used in pasteurization, it may be soiled with certain components in the milk which can be denatured, degraded, caramelized, or concentrated, thereby making soil removal even more difficult.

The second soil results from the interaction between the milk soil residues and the chemicals in the cleaning solution. The problem can be compounded by poor rinsing and poor cleaning of the equipment, resulting in a substantial buildup of residual soil on the surfaces. This can lead to bacterial growth capable of causing a serious health risk when additional milk is processed through the equipment. Also, hardness ions naturally present in the water source used for rinsing or for preparing the concentrate or cleaning solution, can further compound the cleaning problem because of their tendency to react with the cleaning solution and inactivate the builder components of the cleaning solution.

Sodium polyphosphates have been used as the builder of choice in previous aqueous cleaning solutions, but because of the increased use of liquid detergents, where sodium tripolyphosphate has a limited solubility, and increased environmental concerns on the use of phosphorous containing builders, alternative compositions have been investigated. However, with the decrease in phosphate use, performance of the cleaners has also decreased.

U.S. Pat. No. 4,579,676 claims a composition which purportedly avoids a decrease in the cleaning performance of a phosphate free cleaning compositions through the use of a polyacrylic acid in combination with a soil-dispersing amount of a phosphinopolycarboxylic acid. The wash solutions are disclosed to be useful in the cleaning of cleaned-in-place food-processing equipment fouled with greasy or oily soils. However, the composition disclosed in U.S. Pat. No. 4,579,676 continues to use the ecologically undesirable phosphorus in the form of phosphinopolycarboxylic acid.

Another patent, Belgium Patent 762,816, also discloses the use of a reduced amount of phosphorus in a cleaning solution. The solution described contains from 0 to 0.4 wt % of a low level of alkali metal hydroxide, a sequestering agent containing amino and carboxyl groups, from 0.02 to 1 wt. % of condensed phosphate, from 0 to 0.3 wt. % alkali metal silicate and from 0.001 to 0.05 wt. % nonionic surfactant. This composition is supposedly useful for cleaning, with high efficiency and less susceptibility to contamination, heat exchangers used for pasteurizing milk and other dairy and food industry equipment.

A third patent, European Patent 268,873, discloses a cleaning composition based on a quaternary ammonium compound, an alkyl ether carboxylic acid, an alkali metal hydroxide, and a complex-forming aminopolycarboxylic acid. This cleaning composition is purportedly useful for the food industry, especially dairies, does not foam, and also has some disinfectant properties.

SUMMARY OF INVENTION

The present invention is directed to an aqueous cleaning concentrate formulated as a water-dilutable aqueous concentrate comprising an alkali metal hydroxide, an active chlorine source, a water soluble copolymer of a monoethylenically unsaturated dicarboxylic acid and a monoethylenically unsaturated monocarboxylic acid and optionally an alkali metal silicate. It is a further objective of the present invention to formulate an aqueous cleaning solution that does not contain any phosphorus, is suitable for the removal of food soils and performs effectively at high water hardness levels.

It has been found the objectives of this invention can be achieved by the use of copolymers of monoethylenically unsaturated dicarboxylic acids and monoethylenically unsaturated monocarboxylic acids in an alkaline, chlorine-containing composition, with said copolymer aiding in the complete removal of residual fatty and oily soil.

DETAILED DESCRIPTION OF THE INVENTION

Most milk soils are composed of a protein-calcium-fat complex. Although the mechanism of the process set forth herein is not fully understood, it is believed that the copolymer contained in the detergent composition of this invention interacts with the protein-calcium-fat complex on the surface of stainless steel food processing equipment, removing the calcium, and thereby enabling other detergent components to react with the fat and the protein. When the fat and the protein are in the sodium or ionized from, sodium hydroxide can saponify the fat, and chlorine can break the protein into water soluble fragments. This conjecture is supported by the fact that when nonfat milk is used as the soil source, no cleaning problem existed as measured by the test procedure herein described. Also, the copolymers of this invention have a greater affinity for calcium as compared to previously described acrylic homopolymers. Furthermore, since there is not enough polymer in the detergent bath to sequester all the hardness ions, especially at high hardnesses, the polymer must be interacting with the calcium at a specific location, such as the substrate surface, and not improving the cleaning by dispersing more soil or by interacting with the calcium in the aqueous media. The theory of this invention is presented here as a possible explanation of the surprising results obtained and in no way is intended to limit the scope of this invention.

Substitution of the copolymer of this invention for phosphorous containing compounds should be considered in any area where the use of phosphates is restricted. Since most food soils contain fats, proteins and minerals, this invention is applicable to the cleaning of any hard surface, such as glass or metal, where food soils have to be removed. Some specific applications of this invention would include automatic dishwasher detergents and institutional and industrial warewash detergents.

Additionally, because of the stability of the copolymer of this invention to available chlorine, this copolymer could be applicable to any situation where a soil removal aid in an alkaline, chlorinated liquid is needed.

The present invention relates to an alkaline, aqueous cleaning concentrate and cleaning solution comprising an alkali metal hydroxide, an active chlorine source, water soluble copolymers of a monoethylenically unsaturated dicarboxylic acid and a monoethylenically unsaturated monocarboxylic acid and optionally an alkali metal silicate.

Specifically, the copolymer of this invention contains as copolymerized monomer units of from 95 to 30% by weight of a monoethylenically unsaturated monocarboxylic acid and from 5 to 70% by weight of a monoethylenically unsaturated dicarboxylic acid. The more preferable range is from 90 to 70% by weight of the monoethylenically unsaturated monocarboxylic acid and from 10 to 30% by weight of the monoethylenically unsaturated dicarboxylic acid and the even more preferable range is from 85 to 75% by weight of the monoethylenically unsaturated monocarboxylic acid and from 15 to 25% by weight of the monoethylenically unsaturated dicarboxylic acid.

Starting comonomers used in the preparation of these copolymers are monoethylenically unsaturated dicarboxylic acids containing from 4 to 6 carbon atoms per molecule, their alkali metal and ammonium salts, and the anhydrides of the cis dicarboxylic acids. Examples of suitable monomers include maleic acid, itaconic acid, mesaconic acid, fumaric acid, citraconic acid and the anhydrides of cis dicarboxylic acids, such as maleic anhydride. Maleic anhydride is the more preferred of these monomers.

Starting comonomers also include monoethylenically unsaturated monocarboxylic acids containing from 3 to 6 carbon atoms per molecule and include acrylic acid, methacrylic acid, vinyl acetic acid, crotonic acid and acryloxypropionic acid. The more preferred monoethylenically unsaturated monocarboxylic acid is acrylic acid.

Other starting monomers can be carboxyl-free monoethylenically unsaturated monomers which include alkyl esters of acrylic or methacrylic acids such as methyl acrylate, ethyl acrylate, butyl acrylate, methyl methacrylate, ethyl methacrylate, butyl methacrylate and isobutyl methacrylate; hydroxyalkyl esters of acrylic or methacrylic acids such as hydroxyethyl acrylate, hydroxypropyl acrylate, hydroxyethyl methacrylate, and hydroxypropyl methacrylate; acrylamide, methacrylamide, N-tertiary butyl acrylamide, N-methyl acrylamide, N,N-dimethyl acrylamide; acrylonitrile, methacrylonitrile, allyl alcohol, allyl sulfonic acid, allyl phosphonic acid, vinylphosphonic acid, dimethylaminoethyl acrylate, dimethylaminoethyl methacrylate, phosphoethyl methacrylate, N-vinyl pyrollidone, N-vinylformamide, N-vinylimidazole, vinyl acetate, styrene, vinyl sulfonic acid and its salts, and 2-acrylamido-2-methyl propane sulfonic acid (AMPS) and its salts. The concentration of carboxyl-free monoethylenically unsaturated monomers can be from 0 to about 80% by weight of the total monomer concentration. The concentration is typically up to 35%, and is dependent upon the solubility of the particular monomer in the reaction mixture.

These copolymers can be made by a heel charge process whereby the monoethylenically unsaturated dicarboxylic acid is placed in a reactor, to which a feed of initiator and monoethylenically unsaturated monocarboxylic acid is added, or a co-feed process, whereby the monoethylenically unsaturated dicarboxylic acid is feed into the reactor concurrently with the monoethylenically unsaturated monocarboxylic acid. This co-feed process is disclosed in copending U.S. application Ser. No. 353,376 (commonly assigned to the same assignee as the present invention).

The range of molecular weights, Mw as measured by aqueous gel permeation chromatography (GPC), is from about 4,000 to 100,000, more preferably from about 10,000 to 30,000 and even more preferably from about 10,000 to 25,000.

The alkali metal hydroxide can be any type commonly used in the art such as sodium hydroxide, potassium hydroxide or mixtures thereof. Also, the chlorine source can be either organic or inorganic including alkali metal and alkaline earth metal hypochlorites, hypochlorite addition products, chloramines and chlorimines, chloramides and chlorimides. Typically these compounds include sodium hypochlorite, potassium hypochlorite, monobasic calcium hypochlorite, dibasic magnesium hypochlorite, chlorinated trisodium phosphate dodecahydrate, potassium dichloroisocyanurate, trichlorocyanuric acid, sodium dichloroisocyanurate dihydrate, 1,3-dichloro-5,5-dimethylhydantoin, N-chlorosulfamide, Chloramine T, Dichloramine T, Chloramine B, Dichloramine B, chlorine gas or mixtures thereof. The more preferred source of chlorine is sodium hypochlorite.

The cleaning concentrate of the present invention contains: from 2.5 to 35% alkali metal hydroxide, more preferably from 5 to 15%, and more preferably 10%; from 1 to 5% available chlorine, more preferably from 2 to 4% and more preferably 3%; from 0.25 to 20% polymer solids, more preferably from 3 to 15% and more preferably 5.1%; and the remainder is water or other components commonly known to those skilled in the art. Optionally, sodium silicate can be used at a level of up to 10%, more preferably from 2 to 7%, and even more preferably 4.7% as sodium silicate solids.

Other components that may be contained in the cleaning concentrate and/or cleaning solution of the present invention are any of the usual adjuvants found in detergents of this type such as inorganic phosphates, citrates, ethylenediaminetetraacetic acid, nitrilotriacetic acid, carboxyalkylamines, surfactants and homopolymer of polyacrylic acid. To form the cleaning solution of the present invention, the cleaning concentrate may be diluted to about 0.1 to 10% with water.

A representative procedure for the synthesis of the polymers used in the formulations of the present invention is described in the Example below.

EXAMPLE

Polymer Preparation

To a two liter four neck flask equipped with a mechanical stirrer, reflux condenser and addition funnels, were added 190 grams of deionized water, 6 grams of a 0.15% by weight solution of copper (II) sulfate pentahydrate dissolved in deionized water and 42.4 grams of maleic anhydride. This solution was heated to reflux at which time 200 grams of glacial acrylic acid, an initiator solution of 40 grams of deionized water and 12.5 grams of sodium persulfate, and a neutralizing solution of 217 grams of 50% sodium hydroxide, 75 equivalent percent based on the monomers, were fed into the flask linearly and separately over 2 hours while maintaining reflux. When the addition was complete the system was held at reflux for twenty minutes, then cooled to 60° C. and the solution pH was adjusted with the addition of 52 grams of a 50% solution of NaOH in water.

The resultant pH 6.7 polymer solution had a solids content of 46.0%. Based on gel permeation chromatography (GPC), the weight average molecular weight (Mw) was 15,200 and the number average molecular weight (Mn) was 7440. Residual maleic acid content was 0.2% and residual acrylic acid content was 0.01%.

Detergent Testing

A detergent formulation utilized for the testing of this invention had the following composition: 10% sodium hydroxide, 3% available chlorine, and 5.1% polymer solids. Sodium hydroxide levels of 14% were also employed in some tests to assess the effect of higher levels of alkali on the cleaning performance as compared to the use of the polymer to boost cleaning. Sodium silicate was also used in some of the testing at a level of 4.7% sodium silicate solids, which is equivalent to approximately 3.3% silicate solids ($SiO_2$). The performances of these detergent compositions were compared to a typical commercial product, Interest ® (trademark of the Diversey-Wyandotte Corporation) detergent, which is a phosphate based composition.

The detergents, both those of this invention and the Interest ® detergent, were tested at concentrations of from about 0.1% use level (on an as is basis) to about 2% detergent concentration in the bath. The detergents were tested predominately against a multicycle-deposited cold milk soil. The substrates soiled in the testing were 304 stainless steel panels measuring 1"×3"×0.037". The water used for dilution of the detergent and cleaning of the panels contained from 100 ppm to 600 ppm hardness as $CaCO_3$ and 225 ppm sodium bicarbonate, regardless of the water hardness.

The cold milk soiled panels were prepared by precleaning them with methanol, immersing them in a 1% solution of Interest ® detergent for 15 minutes, rinsing them with deionized water and then drying them. The chemically cleaned panels (6 at a time) were then immersed in fresh whole milk (Vitamin A and D—not skim or low fat) to about ⅞ths of their total length and agitated for exactly 15 minutes. This was the soiling portion of the test.

After the 15 minute soiling process, the panels were removed, rinsed in 120° F. running tap water with a hardness of 200 ppm as $CaCO_3$. Each test panel was then cleaned in detergent solution maintained at 60° C. in a shaker bath. The detergent solution contained the water hardness and detergent concentrations listed in the examples. The detergent solution also contained two drops of milk added as an additional stress to the test. After the panels were exposed to the agitated detergent solution for ten minutes, the test panels were removed and rinsed in 120° F. running tap water. This constituted one cycle.

The panels were then placed back in the milk bath to start the second cycle of soiling and cleaning. In all, each panel was exposed to five complete soiling, cleaning and rinsing cycles.

After the panels were rinsed in tap water for the final time, they were immersed in a 1% protein dye solution for 2-3 minutes (the protein dye used was Safranine ® O). The dye solution immediately attached to any milk soil present that had not been removed by the detergent solutions. Depending on the amount of milk soil remaining on the panel, varying degrees of red stain resulted, the darker the red stain the more milk soil left on the panels. The stained panels were then dried with forced hot air and graded using the following scale:

| Rating | Appearance |
|---|---|
| 0 | Panel was clean |
| 1 | A dull film was evident but no red color |
| 2 | Some red stain was seen |
| 3 | Noticeable red color covered 50% of the panel |
| 4 | Red color covered the enitre panel |
| 5 | Very deep red color covered the entire panel |

The results of testing demonstrate that the detergents of this invention are useful for the removal of milk soils. The results also show that the copolymers of this invention are superior to previously described acrylic homopolymers, even at equivalent molecular weights, when higher (>300 ppm) water hardnesses are used.

At higher hardnesses all polymer formulations tended to allow the formation of a scale on the test panel. The addition of sodium silicate prevented this scale formation with the copolymers of this invention, but not with acrylic homopolymers.

EXAMPLE 1

Water hardness: 100 ppm

| | None | Control | Interest ® | A | B | C |
|---|---|---|---|---|---|---|
| Stain (Rank) | 1(2) | 1(2) | 0(1) | 0(1) | 0(1) | 2(3) |
| Scale | None → | | | | | |

Control: 4,500 Mw sodium polyacrylate

Copolymers of the Present Invention:

A—15,200 Mw 80:20 acrylic:maleic, Na salt

B—15,300 Mw 80:20 acrylic:maleic, Na salt

C—30,000 Mw 65:35 acrylic:maleic, Na salt

EXAMPLE 2

Water hardness: 400 ppm

| | Control | Interest ® | A | B |
|---|---|---|---|---|
| Stain (Rank) | 3(3) | 1(1) | 2(2) | 3(3) |
| Scale | None → | | | |

Control: 4,500 Mw sodium polyacrylate

Copolymers of the Present Invention:

A—15,300 Mw 80:20 acrylic:maleic, Na salt

B—20,000 Mw 90:10 acrylic:maleic, Na salt

EXAMPLE 3

Water hardness: 400 ppm

| | None | Control | Interest ® | A | B | C |
|---|---|---|---|---|---|---|
| Stain (Rank) | 3(3) | 3(3) | 0(1) | 1(2) | 3(3) | 3(3) |
| Scale | None → | | | | | |

Control: 4,500 Mw sodium polyacrylate
Copolymers of the Present Invention:
A—15,300 Mw 80:20 acrylic:maleic, Na salt
B—3,390 Mw 70:20:10 acrylic:maleic:AMPS, Na salt
C—18,000 Mw 45:35:20 acrylic:maleic:MAA, Na salt

EXAMPLE 4

Water hardness: 400 ppm

| | None | Control | Interest ® | A | B | C |
|---|---|---|---|---|---|---|
| Stain (Rank) | 3(3) | 3(3) | 0(1) | 1(2) | 3(3) | 3(3) |
| Scale | None → | | | | | |

Control: 4,500 Mw sodium polyacrylate
Copolymers of the Present Invention:
A—15,300 Mw 80:20 acrylic:maleic, Na salt
B—26,000 Mw 80:20 acrylic:maleic, Na salt
C—20,000 Mw 80:20 acrylic:maleic, Na salt

EXAMPLE 5

Water hardness: 400 ppm

| | Control | Interest ® | A | B | C | D |
|---|---|---|---|---|---|---|
| Stain (Rank) | 3(4) | 1(1) | 1(1) | 2(2) | 2.5(3) | 2.5(3) |
| Scale | None → | | | | Light | None |

Control: 4,500 Mw sodium polyacrylate
Copolymers of the Present Invention:
A—15,300 Mw 80:20 acrylic:maleic, Na salt
B—15,200 Mw 80:20 acrylic:maleic, Na salt
C—20,000 Mw 80:20 acrylic:maleic, Na salt
D—30,000 Mw 65:35 acrylic:maleic, Na salt

EXAMPLE 6

Water hardness: 400 ppm

| | Control | Interest ® | A | B | C | D |
|---|---|---|---|---|---|---|
| Stain (Rank) | 3(4) | 0(1) | 2(2) | 2.5(3) | 3(4) | 2.5(3) |
| Scale | None → | | | | Light | None |

Control: 4,500 Mw sodium polyacrylate
Copolymers of the Present Invention:
A—15,300 Mw 80:20 acrylic:maleic, Na salt
B—9,100 Mw 80:20 acrylic:maleic, Na salt
C—8,600 Mw 70:30 acrylic:maleic, Na salt
D—12,000 Mw 65:35 acrylic:maleic, Na salt

EXAMPLE 7

Water hardness: 400 ppm

| | Control | Interest ® | A | B | C | D |
|---|---|---|---|---|---|---|
| Stain (Rank) | 3(4) | 0(1) | 1(2) | 3(4) | 3(4) | 2(3) |
| Scale | None → | | | | Light | None |

Control: 4,500 Mw sodium polyacrylate
Copolymers of the Present Invention:
A—15,300 Mw 80:20 acrylic:maleic, Na salt
B—9,100 Mw 65:35 acrylic:maleic, Na salt
C—17,600 Mw 65:35 acrylic:maleic, Na salt
D—19,000 Mw 80:20 acrylic:maleic, Na salt

EXAMPLE 8

Water hardness: 400 ppm

| | Control | Interest ® | A | B | C | D |
|---|---|---|---|---|---|---|
| Stain (Rank) | 3(4) | 0(1) | 0(1) | 2(3) | 2(3) | 1(2) |
| Scale | None → | Light | None | Med | Med | None |

Control: 4,500 Mw sodium polyacrylate
Copolymers of the Present Invention
A—15,300 Mw 80:20 acrylic:maleic, Na salt
B—8,400 Mw 76:24 acrylic:itaconic, Na salt
C—17,400 Mw 84:16 acrylic:itaconic, Na salt
D—14,100 Mw 76:24 acrylic:itaconic, Na salt

EXAMPLE 9

Water hardness: 400 ppm

| | Control | Interest ® | A | B | C | D |
|---|---|---|---|---|---|---|
| Stain (Rank) | 3(5) | 0(1) | 1(2) | 2.5(3) | 2.5(3) | 3(4) |
| Scale | None → | | | Med → | | |

Control: 4,500 Mw sodium polyacrylate
Copolymers of the Present Invention
A—15,300 Mw 80:20 acrylic:maleic, Na salt
B—3,650 Mw 80:20 acrylic:maleic, Na salt
C—3,850 Mw 80:20 acrylic:itaconic, Na salt
D—5,700 Mw 70:20:10 acrylic:maleic:MAA, Na salt

EXAMPLE 10

Water hardness: 400 ppm

| | Control | Interest ® | A | B | C | D |
|---|---|---|---|---|---|---|
| Stain (Rank) | 3(5) | 0(1) | 1(2) | 1(2) | 2(3) | 2.5(4) |
| Scale | None → | | | | | |

Control: 4,500 Mw sodium polyacrylate
Copolymers of the Present Invention:
A—15,300 Mw 80:20 acrylic:maleic, Na salt
B—56,000 Mw 80:20 acrylic:maleic, Na salt
C—12,000 Mw 85:35 acrylic:maleic, Na salt
D—49,000 Mw 80:20 acrylic:maleic, Na salt

EXAMPLE 11

Water hardness: 600 ppm

| | None | Control | Interest ® | A | B | C |
|---|---|---|---|---|---|---|
| Stain (Rank) | 3(3) | — | 1(1) | 1(1) | 2(2) | 2(2) |

-continued

| | None | Control | Interest ® | A | B | C |
|---|---|---|---|---|---|---|
| Scale | Slight | Heavy | None → | | | |

Control: 4,500 Mw sodium polyacrylate
Copolymers of the Present Invention:
A—15,300 Mw 80:20 acrylic:maleic, Na salt
B—12,000 Mw 65:35 acrylic:maleic, Na salt
C—15,200 Mw 80:20 acrylic:maleic, Na salt

EXAMPLE 12

Water hardness: 600 ppm

| | Control | Interest ® | A | B | B | B |
|---|---|---|---|---|---|---|
| Silicate (SiO2) | None | — | None | None | 1.7% | 3.3% |
| Stain (Rank) | 3(3) | 0(1) | 2(2) | 2(2) | 2(2) | 2(2) |
| Scale | Med | None | None | Slight | None | None |

Control: 4,500 Mw sodium polyacrylate
Copolymers of the Present Invention:
A—15,300 Mw 80:20 acrylic:maleic, Na salt
B—14,700 Mw 80:20 acrylic:maleic, Na salt

EXAMPLE 13

Water hardness: 600 ppm

| | Interest | Control | Control | B | B | B |
|---|---|---|---|---|---|---|
| Silicate (SiO2) | — | None | 1.7% | None | 1.7% | 0.9% |
| Stain (Rank) | 0(1) | 4(5) | 3(4) | 1(2) | 1(2) | 2(3) |
| Scale | None | None | None | Med | None | Slight |

Control: 4,500 Mw sodium Polyacrylate
Copolymers of the Present Invention:
B—14,700 Mw 80:20 acrylic:maleic, Na salt

EXAMPLE 14

Water hardness: 400 ppm

| | None | Con-trol | Con-trol | Control | Interest ® | A |
|---|---|---|---|---|---|---|
| Polymer level | — | X1 | X2 | X4 | — | X1 |
| Stain (Rank) | 2(3) | 2(3) | 1(2) | 0(1) | 1(2) | 0(1) |
| Scale | None → | | | | | |

Control: 4,500 Mw sodium polyacrylate
Copolymers of the Present Invention:
A—15,300 Mw 80:20 acrylic:maleic, Na salt

EXAMPLE 15

Water hardness: 400 ppm

| | Control | Interest ® | A | A | A | A |
|---|---|---|---|---|---|---|
| Polymer level | X1 | — | X1 | X.75 | X.75 | X.50 |
| Stain (Rank) | 4(4) | 0(1) | 0(1) | 2(3) | 1(2) | 2(3) |
| Scale | None → | | | | | |

Control: 4,500 Mw sodium polyacrylate
Copolymers of the Present Invention
A—15,300 Mw 80:20 acrylic:maleic, Na salt

EXAMPLE 16

Water hardness: 400 ppm

| | Control | Interest | A | B | C | D |
|---|---|---|---|---|---|---|
| Stain (Rank) | 1(2) | 0(1) | 1(2) | 1(2) | 1(2) | 1(2) |
| Scale | None → | | | Med | Med | Light |

Control: 4,500 Mw sodium polyacrylate
Copolymers of the Present Invention:
A—15,300 Mw 80:20 acrylic:maleic, Na salt
B—11,600 Mw 75:25 acrylic:maleic, Na salt
C—11,500 Mw 70:30 acrylic:maleic, Na salt
D—14,700 Mw 80:20 acrylic:maleic, Na salt

EXAMPLE 17

Water hardness: Deionized water

| | Control | Interest ® | A | B | C | D |
|---|---|---|---|---|---|---|
| Stain (Rank) | 0(1) | 0(1) | 0(1) | 0(1) | 0(1) | 0(1) |
| Scale | None → | | | | | |

Control: 4,500 Mw sodium polyacrylate
Copolymers of the Present Invention:
A—15,300 Mw 80:20 acrylic:maleic, Na salt
B—11,600 Mw 75:25 acrylic:maleic, Na salt
C—11,500 Mw 70:30 acrylic:maleic, Na salt
D—14,700 Mw 80:20 acrylic:maleic, Na salt

EXAMPLE 18

Water hardness: 600 ppm

| | None | Con-trol | Interest ® | B | A | C |
|---|---|---|---|---|---|---|
| Stain (Rank) | 3(3) | 3(3)? | 1(1) | 1(1)? | 1(1) | 1.5(2) |
| Scale | None | Heavy | None | Heavy | None → | |

Control: 4,500 Mw sodium polyacrylate
Copolymers of the Present Invention:
A—15,300 Mw 80:20 acrylic:maleic, Na salt
B—18,000 Mw sodium polyacrylate
C—14,700 Mw 80:20 acrylic:maleic, Na salt

EXAMPLE 19

Water hardness: 400 ppm
Detergent contains 11% NaOH

| | Con-trol | Interest ® | B | B | A | C |
|---|---|---|---|---|---|---|
| Polymer Level | X1 | — | X1 | X2 | X1 | X1 |
| Stain (Rank) | 3(5) | 0(1) | 2(3) | 2.5(4) | 0(1) | 2(3) |
| Scale | None | None | Light | None | None | Light |

Control: 4,500 Mw sodium polyacrylate
Copolymers of the Present Invention:
A—15,300 Mw 80:20 acrylic:maleic, Na salt
B—18,000 Mw sodium polyacrylate
C—14,700 Mw 80:20 acrylic:maleic, Na salt

We claim:

1. A cleaning concentrate consisting of:

(a) about 0.25 to 20% of a water-soluble copolymer having monomer units of about 95 to 30% of a monoethylenically unsaturated monocarboxylic acid, about 5 to 70% of a monoethylenically unsaturated dicarboxylic acid and, optionally, carboxyl-free monoethylenically unsaturated monomers and said copolymer having a molecular weight of about 4000 to 100,000;

(b) about 2.5 to 35% of an alkali metal hydroxide;

(c) an active chlorine source to provide the concentrate with about 1 to 5% available chlorine; and the remainder of said concentrate is selected from the group consisting of inorganic phosphates, citrates, ethylenediaminetetraacetic acid, nitrilotriacetic acid, carboxyalkylamines, surfactants, homopolymer of polyacrylic acid and water, such that the total concentration of all components is equal to 100 percent.

2. The cleaning concentrate of claim 1 wherein said monoethylenically unsaturated dicarboxylic acid is selected from the group consisting of maleic acid, itaconic acid, mesaconic acid, fumaric acid, citraconic acid and the anhydrides of cis dicarboxylic acids, such as maleic anhydride.

3. The cleaning concentrate of claim 1 wherein said monoethylenically unsaturated dicarboxylic acid is maleic acid.

4. The cleaning concentrate of claim 1 wherein said monoethylenically unsaturated monocarboxylic acid is selected from the group consisting of acrylic acid, methacrylic acid, vinyl acetic acid, crotonic acid and acryloxypropionic acid.

5. The cleaning concentrate of claim 1 wherein said monoethylenically unsaturated monocarboxylic acid is acrylic acid.

6. The cleaning concentrate of claim 1 wherein said carboxyl-free monoethylenically unsaturated monomers are selected from the group consisting of alkyl esters of acrylic or methacrylic acids such as methyl acrylate, ethyl acrylate, butyl acrylate, methyl methacrylate, ethyl methacrylate, butyl methacrylate and isobutyl methacrylate; hydroxyalkyl esters of acrylic or methacrylic acids such as hydroxyethyl acrylate, hydroxypropyl acrylate, hydroxyethyl methacrylate, and hydroxypropyl methacrylate; acrylamide, methacrylamide, N-tertiary butyl acrylamide, N-methyl acrylamide, N,N-dimethyl acrylamide; acrylonitrile, methacrylonitrile, allyl alcohol, allyl sulfonic acid, allyl phosphonic acid, vinylphosphonic acid, dimethylaminoethyl acrylate, dimethylaminoethyl methacrylate, phosphoethyl methacrylate, N-vinyl pyrollidone, N-vinylformamide, N-vinylimidazole, vinyl acetate, styrene, vinyl sulfonic acid and its salts, and 2-acrylamido-2-methyl propane sulfonic acid (AMPS) and its salts.

7. The cleaning concentrate of claim 1 wherein said copolymer is produced from a monomeric mix of about 85 to 75% of a monoethylenically unsaturated monocarboxylic acid and about 15 to 25% of a monoethylenically unsaturated dicarboxylic acid.

8. The cleaning concentrate of claim 1 wherein said copolymer is produced from a monomeric mix of 80% acrylic acid and 20% maleic acid.

9. The cleaning concentrate of claim 1 wherein said alkali metal hydroxide comprises sodium hydroxide, potassium hydroxide or mixtures thereof.

10. The cleaning concentrate of claim 1 wherein said copolymer has a molecular weight of about 10,000 to 25,000.

11. The cleaning concentrate of claim 1 wherein said active chlorine source is an alkali metal hypochlorite.

12. The cleaning concentrate of claim 1 wherein said active chlorine sources is sodium hypochlorite.

13. A cleaning solution consisting of about 0.1 to about 10 percent of the concentrate of claim 1 and about 90 to about 99.9 percent water.

* * * * *